United States Patent [19]

Suzuki et al.

[11] 3,965,790

[45] June 29, 1976

[54] ELECTRONIC MUSICAL INSTRUMENT HAVING DYNAMIC RANGE VARIABLE EXPRESSION CONTROL

[75] Inventors: Shigeru Suzuki; Takeshi Adachi, both of Hamamatsu, Japan

[73] Assignee: Nippon Gakki Seizo Kabushiki Kaisha, Hamamatsu, Japan

[22] Filed: Sept. 4, 1974

[21] Appl. No.: 503,529

[30] Foreign Application Priority Data

| | | |
|---|---|---|
| Sept. 5, 1973 | Japan | 48-99927 |
| Nov. 14, 1973 | Japan | 48-128016 |
| Dec. 14, 1973 | Japan | 48-144010[U] |
| Dec. 14, 1973 | Japan | 48-140685 |

[52] U.S. Cl. ..... 84/1.27; 84/DIG. 19; 179/1 VL; 323/74; 323/79; 323/94 R; 333/81 R

[51] Int. Cl.² ..... G10H 1/02; H01P 1/22

[58] Field of Search ..... 84/1.01, 1.11, 1.18, 84/1.19, 1.24, DIG. 19, 1.09, 1.1, 1.27; 250/199, 216, 578; 323/69, 74, 79, 94 R; 333/81 R; 330/59; 179/1 VL

[56] References Cited

UNITED STATES PATENTS

| | | | |
|---|---|---|---|
| 1,916,187 | 6/1933 | Read, Jr. | 179/1 VL X |
| 2,482,820 | 9/1949 | Wolfson et al. | 323/69 X |
| 2,653,299 | 9/1953 | Ginzton | 323/69 X |
| 2,698,420 | 12/1954 | Saraga | 333/81 R X |
| 2,854,643 | 9/1958 | Wigan et al. | 333/81 R |
| 2,867,774 | 1/1959 | Bell | 333/81 R X |
| 2,872,134 | 2/1959 | Eckhardt | 323/79 X |
| 2,888,636 | 5/1959 | McManis | 323/79 X |
| 2,947,934 | 8/1960 | Bolie | 323/74 |
| 3,020,488 | 2/1966 | Miranda et al. | 330/59 |
| 3,036,158 | 5/1962 | Romano | 179/1 VL |
| 3,098,195 | 7/1963 | Lennon et al. | 323/79 |
| 3,182,271 | 5/1965 | Aiken | 179/1 VL X |
| 3,453,529 | 7/1969 | Richman | 323/79 |
| 3,514,522 | 5/1970 | Mussulman | 84/1.18 |
| 3,609,204 | 9/1971 | Peterson | 84/1.01 X |
| 3,619,469 | 11/1971 | Adachi | 84/1.24 X |
| 3,672,253 | 6/1972 | Hiyama | 84/1.27 |
| 3,868,604 | 2/1975 | Tongue | 333/81 R X |

*Primary Examiner*—L. T. Hix
*Assistant Examiner*—Stanley J. Witkowski
*Attorney, Agent, or Firm*—Cushman, Darby & Cushman

[57] ABSTRACT

In an electronic musical instrument, an expression control circuit constituted by a first variable resistor is connected in the path of the tone signal. A second variable resistor is connected in series with or in parallel to the first. A third variable resistor is connected in shunt between the output side of the expression control circuit and the ground. The second and the third variable resistors can adjust the variation range of the tone signal at the output of the first variable resistance.

13 Claims, 18 Drawing Figures

ELECTRONIC MUSICAL INSTRUMENT HAVING DYNAMIC RANGE VARIABLE EXPRESSION CONTROL

BACKGROUND OF THE INVENTION

1. Field of the invention:

This invention relates to an electronic musical instrument and more particularly to expression control means in an electronic musical instrument.

2. Description of the prior art:

Conventionally, expression control means have been used for controlling the tone volume in electronic musical instruments. The expression control means is connected between the output of the tone coloring circuit and the input of the amplifier and comprises a photoconductive element (variable resistance element) such as CdS element and a light source such as a lamp or a light emitting diode disposed opposite to each other with a shutter plate disposed therebetween. The shutter plate has a through hole of a predetermined shape and is interlocked with a foot plate for the expression control so that the amount of light impinging on the photoconductive element continuously varies according to the depth of the foot plate depression. Thus, the resistance of the photoconductive element is varied according to the depth of the foot plate depression. Hence, the signal level derived from the tone coloring circuit is controlled by the foot plate depression to effect the expression control. The tone volume increases as the expression foot plate is depressed.

According to the conventional expression control means, however, the depression angle of the expression foot plate and the tone signal level are related in one-to-one correspondence and the variation characteristic is constantly represented by a single curve and the values of the dynamic range and the minimum (or maximum) level are fixed and little, if at all varied.

Therefore, in an ensemble play, etc., it is very difficult to carry out the optimum tone volume control. Namely, when one wishes to play the instrument in a narrow tone volume range he should produce expression by minute variations of the foot plate depression, whereas to play the instrument in a wide tone volume range he should manipulate the foot plate almost from the minimum position to the maximum position. Hence, well-trained skill is required for the manipulation of the foot plate.

Further, in such an electronic musical instrument having a plurality of tone generating systems, e.g. one for strings, one for flute, etc., when the plurality of tone generating systems is operated simultaneously to provide musical sounds of a plurality of instruments, the tone volume control by the manipulation of an expression foot plate becomes common for the respective tone generating systems. Hence, musical play rich in musicality cannot be achieved.

In other words, although an electronic musical instrument has an advantage that one can perform a musical play resembling an ensemble play by a plurality of players, it cannot give variations of musical tones nor accents due to the differences in the dynamic ranges of the tone volumes of the respective musical instruments. Usually, the dynamic range of the tone volume is largest for the melody instrument. In conventional electronic musical instrument, however, performance effect due to the variations in the dynamic range has not been provided.

Further, it has been also proposed to dispose a plurality of photoconducting elements against a light source with shutter plates of predetermined shape intervening therebetween. However, the number of shutter plates interlocked with an expression foot plate is at most two. Thus, to afford expression control for more than two tone generating systems is practically impossible according to this method. It can be thought of to provide an expression foot plate for each tone generating system. This leads to very complicated manipulation and musical performance rich in variety cannot be easily achieved.

To solve the above problem, it has been recently proposed to dispose the ends of a plurality of optical fibers against a light source through a shutter plate and a plurality of photoconducting elements at the other ends of the optical fibers. These photoconducting elements are connected in the circuits for controlling the signal levels in the respective tone signal generating systems. Thus, the tone volume control for a plurality of tone signal generating systems can be achieved by the manipulation of a single expression foot plate. Such a system can achieve the tone volume control of a plurality of tone signal generating systems by a single expression foot plate, but because of the use of optical fibers it is accompanied by the practical inconveniences, such as troublesome manufacture, larger size or higher cost.

SUMMARY OF THE INVENTION

This invention intends to solve the drawbacks and inconveniences as described above.

An object of this invention is, therefore, to provide expression control means in an electronic musical instrument capable of arbitrarily varying at least either the dynamic range or the minimum level of the tone signal and preferably both.

Another object of this invention is to provide expression control means in an electronic musical instrument capable of varying the dynamic range and the minimum level for the tone signal in an interlocked manner.

A further object of this invention is to provide expression control means for a plurality of tone signal generating systems in an electronic musical instrument capable of easily and differently controlling the tone signal levels in the respective tone signal generating circuits.

Yet a further object of this invention is to provide an electronic musical instrument having an expression control having a plurality of tone signal generating systems and expression control means capable of controlling the tone volume of the respective tone signal generating systems, the dynamic range and the minimum level of the tone volume being arbitrarily variable at least for one tone signal generating system.

DESCRIPTION OF THE PREFERRED EMBODIMENTS

Figure 1:
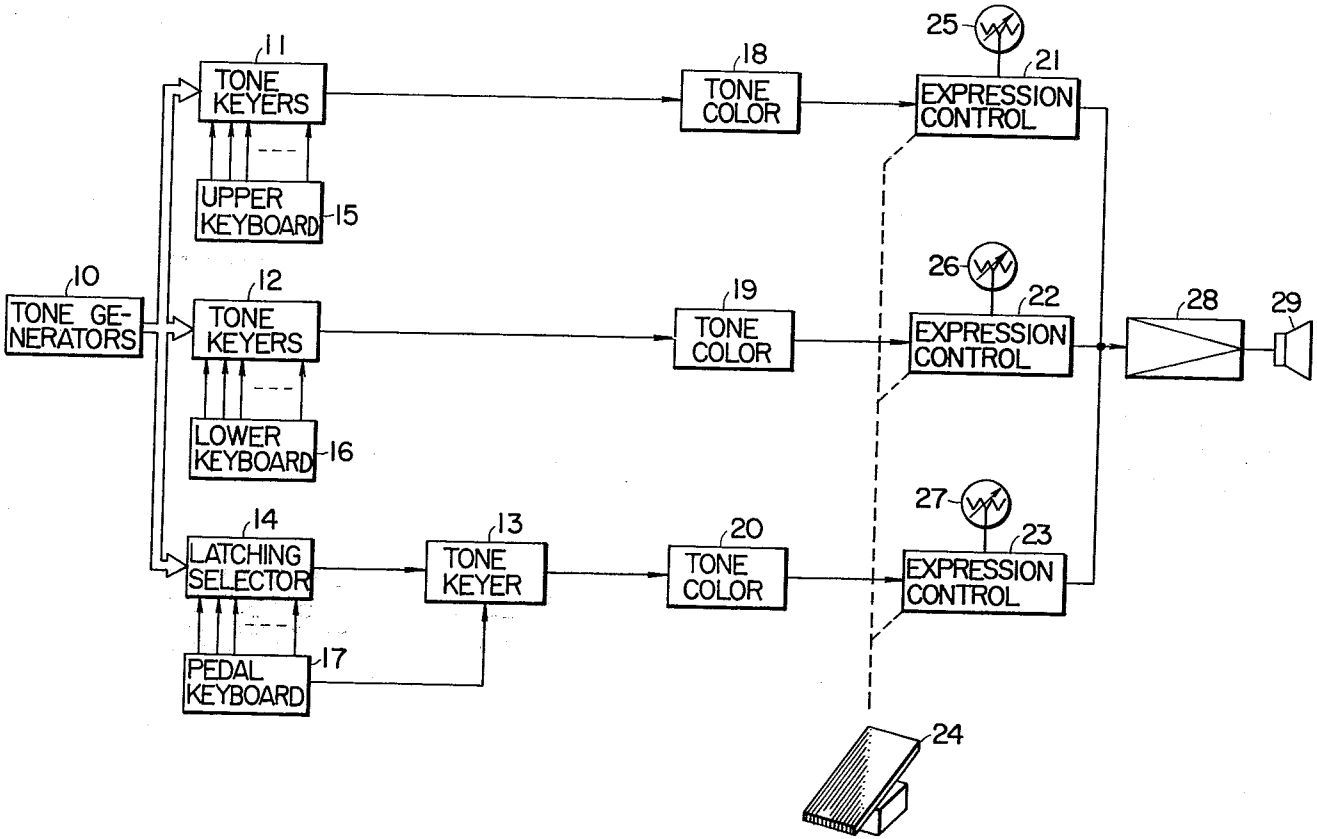
FIG. 1 is a block diagram of an embodiment of an electronic musical instrument according to this invention.

FIG. 1 shows an electronic musical instrument, in which tone signals generated in tone generators 10 are supplied through tone keyers 11, 12 and 13 and tone coloring filters 18, 19 and 20 to expression control means 21, 22 and 23. The tone keyers 11, 12 and 13 are actuated by an upper keyboard 15, a lower keyboard 16 and a pedal keyboard 17, respectively. A latching selector 14 is provided to the pedal keyboard 17. Thus the tone signal generating system for the pedal keyboard is provided with only one tone keyer 13. The tone coloring filters 18, 19 and 20 color the tone, e.g. flute, clarinet, etc. and supply outputs to the expression control means 21, 22 and 23 which are interlocked with a single foot plate 24. The expression control means 21, 22 and 23 are provided with respective controlling manipulators 25, 26 and 27 so as to vary the minimum level and the dynamic range for the tone volume and supply outputs to a loudspeaker system 29 through an amplifier 28.

When a key in the upper keyboard 16 is depressed, a corresponding tone keyer is driven open and a corresponding tone signal generated in the tone generators 10 is fed to the tone coloring filter 18. The filter 18 colors a musical tone signal and supplys it to the expression control 21. The dynamic range and the minimum level for the tone of the upper keyboard developed by depression of foot plate 24 can be controlled by adjusting the manipulator 25. The tone signal is attenuated in the expression control means 21 according to the set position of the manipulator 25 and the depression angle of the expression foot plate 24 to supply a controlled tone signal to the loudspeaker system 29 through the amplifier 28.

Figure 2A:
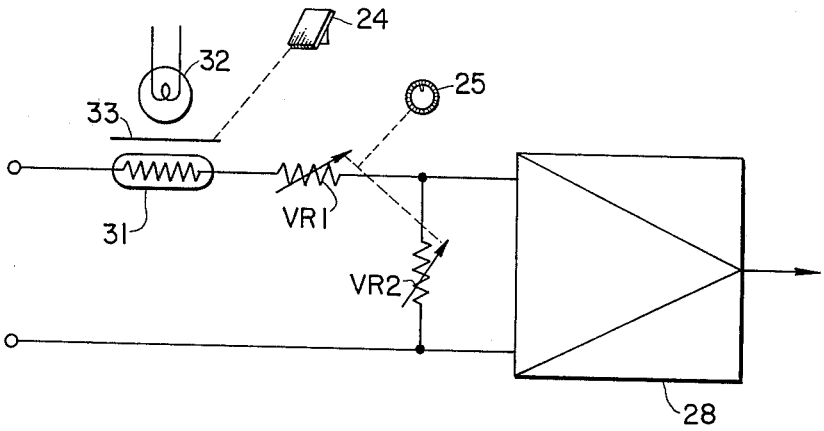
FIG. 2A is a schematic electric circuit diagram of an embodiment of expression control means to be embodied in the electronic musical instrument of FIG. 1 according to this invention.

In FIG. 2A, photoconductive element 31 is disposed against a light source 32 through a shutter plate 33 having a through hole of a predetermined shape. A variable resistor VR1 is connected between the photoconductive element 31 and the amplifier 28 and another variable resistor VR2 is connected between the input terminals of the amplifiers 28. In FIG. 2A, controls corresponding to controls 22 and 23 of FIG. 1 are omitted for clarity. These controls contain similar resistors similarly connected. These resistors form a voltage-dividing circuit. Typical values for these resistances are as follows: the photoconducting element 31 is from 1MΩ (dark) to 1KΩ, VR1 is from 200KΩ to 1KΩ, and VR2 is from 40KΩ to 2KΩ. The shutter plate 33 is interlocked with the common expression foot plate 24. When the expression foot plate 24 is depressed, the shutter plate 33 is displaced correspondingly and the amount of light impinging from the light source 32 onto the photoconducting element 31 is varied. Hence, the resistance of the photoconducting element 31 changes accordingly and the signal level supplied from the tone coloring filter 18 to the amplifier 28 is varied according to the resistance of the photoconducting element 31. Thus, when the expression foot plate 24 is depressed, the amount of light (intensity) impinging on photoconducting element 31 increases and the resistance of photoconducting element 31 decreases. Hence, the ratio of the voltage established across the variable resistor VR2, i.e., the input signal level for the amplifier, to the output voltage of the tone coloring filter 18 increases to produce louder sound. The variable resistors VR1 and VR2 are interlocked with the manipulator 25 which is disposed on a manipulation panel (not shown).

Figure 2B:
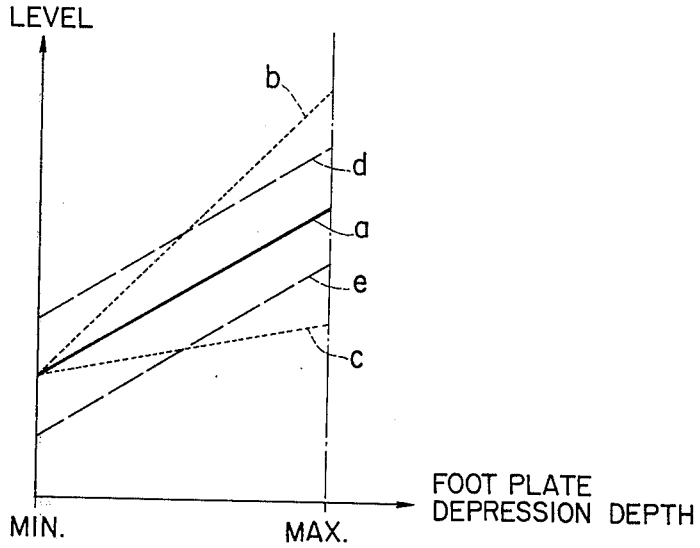
FIGS. 2B and 2C are characteristic charts of the expression control means of FIG. 2A.

To help understanding of the circuit of FIG. 2A, the cases when each one of variable resistances VR1 and VR2 is changed will be considered first, referring to FIG. 2B. In FIG. 2B, the abscissa represents the depression of the expression foot plate 24 and the ordinate represents the signal level at the input of the amplifier 28 represented in dB. Solid line *a* represents the standard state where the variable resistances VR1 and VR2 take medium values. When the foot plate 24 is released, the photoconductive element 31 receives little light and has a large resistance, e.g. 1MΩ. As the foot plate 24 is depressed, the resistance of the photoconductive element 31 decreases and the signal level established across the variable resistor VR2 increases. The resistance of the variable resistor VR1 plays almost no role at the released position since the dark resistance of the photoconducting element 31 is very large, but an important role for determining the gradient of the characteristic curve as the foot plate 24 is depressed. On the other hand, the resistance of the variable reistor VR2 plays a main role for determining the voltage dividing ratio and hence the signal level throughout the foot plate depression range, but a relatively small role in determining the gradient of the characteristic curve.

When the variable reistance VR1 is decreased, the characteristic curve is changed, for example, to dotted line *b.* On the other hand, if the variable resistance VR1 is increased, the characteristic curve is changed, for example, to dotted line *c.*

As is apparent from the above, the dynamic range of the tone volume can be effectively varied by the variable resistance VR1. Here, the minimum level is hardly changed by variation of the resistance VR1.

When the resistance VR2 is varied, the minimum level is effectively varied. Namely, when the resistance VR2 is increased, the minimum level increases to generate a characteristic curve as shown by broken line *d.* When the resistance VR2 is decreased, the minimum level decreases to generate a characterstic as shown by broken line *e*. Here, the dynamic range is subjected to small change by the variation of the resistance VR2 since the resistance VR2 is small compared to the resistance of the photoconductive element 31 and/or the resistance VR1.

Figure 2C:
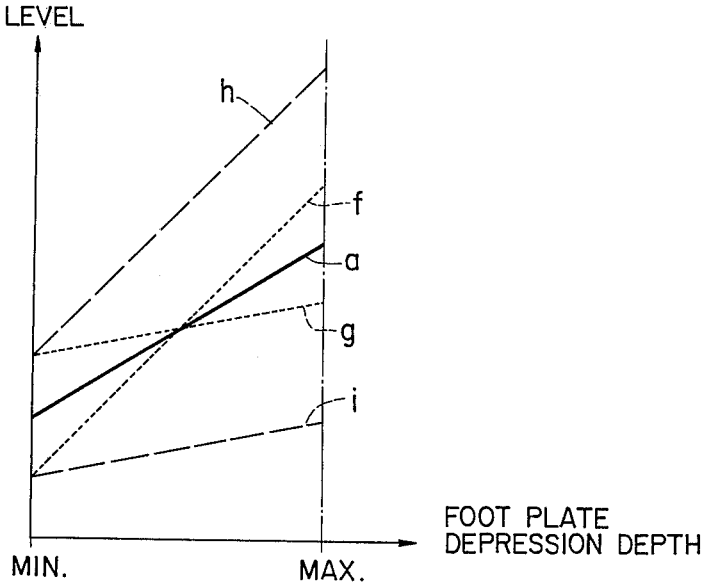

When the variable resistances VR1 and VR2 are interlocked to vary in the same direction, the characteristic curve changes as are shown by dotted lines in FIG. 2C. In FIG. 2C, solid line *a* represents the standard state. If the resistances VR1 and VR2 are decreased, the characteristic curve becomes as shown by dotted line *f* (c.f. lines *b* and *e* in FIG. 2B). If the resistances VR1 and VR2 are increased, the characteristic curve becomes as shown by dotted line *g* (c.f. lines *c* and *d* in FIG. 2B).

On the other hand, if the variable resistances VR1 and VR2 are varied in opposite directions, the characteristic curve changes as shown by broken lines in FIG. 2C. Namely, when the resistance VR1 is decreased and the resistance VR2 is increased, the characteristic curve becomes as shown by broken line *h*. When the resistance VR1 is increased and the resistance VR2 is decreased, a characteristic curve as shown by broken line *i* is produced.

Thus, the dynamic range and the minimum level can be varied by interlocking the variable resistors VR1 and VR2 and varying the resistances thereof.

Figure 3A:
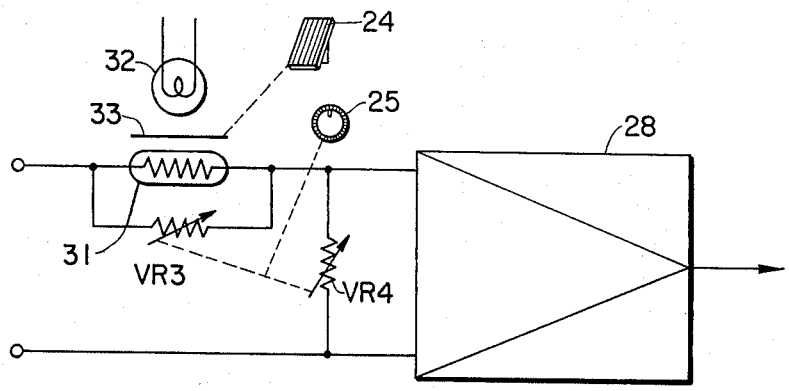
FIG. 3A is a schematic electric circuit diagram of another embodiment of expression control means to be embodied in the electronic musical instrument of FIG. 1 according to this invention.
Figure 3B:
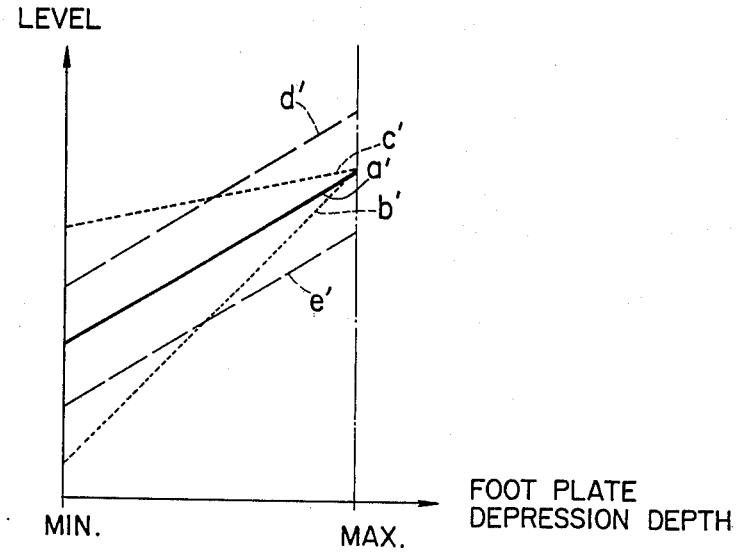
FIGS. 3B and 3C are characteristic charts of the expression control means of FIG. 3A.
Figure 3C:
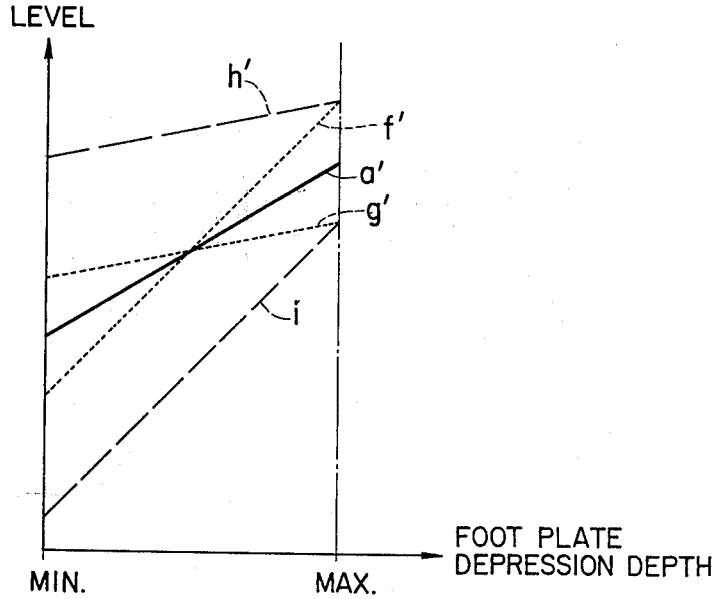

FIG. 3A shows another example of the expression control means, in which a variable resistance VR3 is connected parallel to the photoconducting element 31 and another variable resistance VR4 is connected between the input terminals of the amplifier 28. The parallel connection of the resistances of the photoconducting element 31 and the variable resistance VR3 forms a first resistive portion and the resistance VR4 forms a second resistive portion. The series connection of the first and the second resistive portions forms a voltage dividing circuit and the output voltage is established across the second resistive portion, similar to the case of FIG. 2A. In this case, however, the resistance VR3 performs an opposite function to that of VR1 of FIG. 2A.

Similar to the case of FIG. 2A, the respective influences of the resistances VR3 and VR4 will be described first. When the resistance VR4 is fixed and only the resistance VR3 is varied, the characteristic curve varies from one represented by solid line *a'* to those represented by dotted lines *b'* and *c'*. Namely, when the resistance VR3 is increased (decreased), the resistance of the first resistive portion is increased (decreased) unless the photoconductive element is almost conductive. Thus, the signal level established across the resistance VR4 decreases (increases) and the characteristic curve changes from one as represented by solid line *a'* to one as represented by dotted line *b'* (*c'*). Here, the maximum level is subjected to small change since the resistance of the maximumly illuminated photoconducting element is very small compared to the resistance VR3. When only the resistance VR4 is varied, the voltage dividing ratio is changed. Namely, when the resistance VR4 is increased (decreased), the signal level established thereacross also increases (decreases) and the characteristic curve as represented by solid line *a'* varies to one as represented by dotted line *d'* (*e'*). In short, the dynamic range can be effectively varied by the variable resistance VR3 and the maximum level by the variable resistance VR4.

When the variable resistances VR3 and VR4 are interlocked and varied in the same direction, the characteristic curve represented by *a'* varies to those as represented by *f'* (larger VR3 and VR4) and *g'* (smaller VR3 and VR4). On the other hand, when they are varied in opposite direction, the characteristic curve varies to those as represented by *h'* (smaller VR3 and larger VR4) and *i'* (larger VR3 and smaller VR4).

As is apparent from the above description, the dynamic range and the maximum or minimum level can be effectively varied by adjusting variable resistors connected to an expression controlling variable resistor (photoconducting element).

Figure 4:
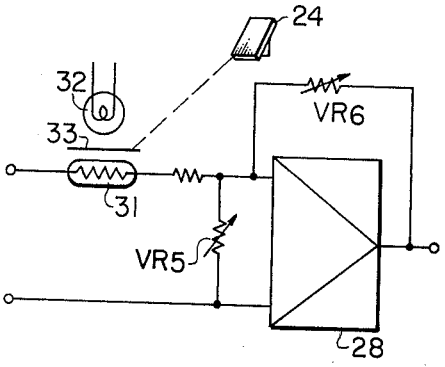
FIG. 4 is a schematic electric circuit diagram of a further embodiment of expression control means according to this invention.

FIG. 4 shows a further embodiment for varying the dynamic range and the minimum level, which may be considered equivalent to the circuit of FIG. 2A. A variable resistance VR1 is connected in series to the photoconducting element 31 so as to vary the dynamic range, but in this embodiment a variable resistor VR6 is connected across the amplifier 28 so as to vary the amplification factor of the amplifier 28 and hence to vary the dynamic range. Another variable resistor VR5 is connected between the input terminals of the amplifier 28 which works to vary the minimum level.

Figure 5A:
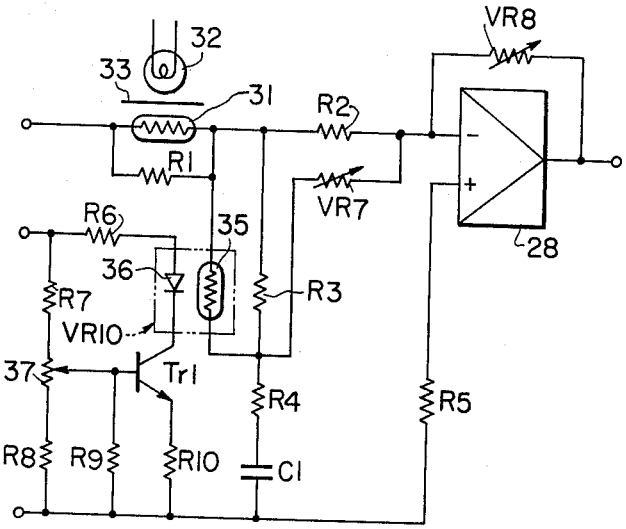
FIG. 5A is an electric circuit diagram of a concrete embodiment of expression control means according to this invention.

FIG. 5A shows a concrete embodiment of the circuit for changing the dynamic range and the minimum level of the tone signal based on the equivalent circuit of FIG. 2A. In the figure, a photoconducting element 31 disposed against a light source 32 through a shutter plate 33 forms an expression controlling element and is connected in parallel with a resistor R1 and with an amplifier 28 through a resistive network. A photocoupler consisting of a photoconducting element 35 and a light emitting diode 36 works as a variable resistor VR10. The resistive network including resistors R2 and R3 and the variable resistors VR7 and VR10 couples the photoconducting element 31 and the amplifier 28. A manipulator 37 corresponding to those 25, 26 and 27 consists of a variable resistor and is disposed on a manipulation panel (not shown). The movable terminal of the variable resistor 37 is connected to the base of a transistor Tr1. The base bias is given by a voltage dividing network consisting of resistors R7, R8 and R9 and the variable resistor 37. Resistors R6 and R10 work as a collector resistor and an emitter resistor. Series connection of a resistor respectively R4 and a capacitor C1 works to give loudness control effect. A variable resistance VR8 is connected between the output and the input of the amplifier 28 to control the amplification factor, and R5 is a resistor.

When the manipulator 37 is manipulated, the base bias for the transistor Tr1 is varied and the collector current is varied. Since the light emitting diode 36 is connected with the collector of the transistor Tr1, the amount of the light emitted from the light emitting diode 36 is varied according to the collector current and the impedance of the photoconducting element 35 is varied correspondingly. When the resistance of the photoconducting element 35 becomes smaller, a larger current is by-passed through the resistors 35 and R4 and the capacitor C1. When the resistance of the element 35 becomes larger, a larger current is made to flow through the resistor R2. The parallel connection of the two resistances 35 and R3, the resistance R2 and the resistance VR7 constitute a three terminal network of a delta shape which can be considered to be equivalent to a three terminal network of a Y shape consisting of three branch resistances. Therefore, the single variable resistor VR10 constituted by the photoconducting element 35 works the role of the two variable resistors VR1 and VR2 of the circuit of FIG. 2A. The dynamic range and the minimum level are varied according to the amount of light impinging on the element 35. The variable resistor VR7 can also be adjusted to control the circuit characteristics.

Figure 5B:
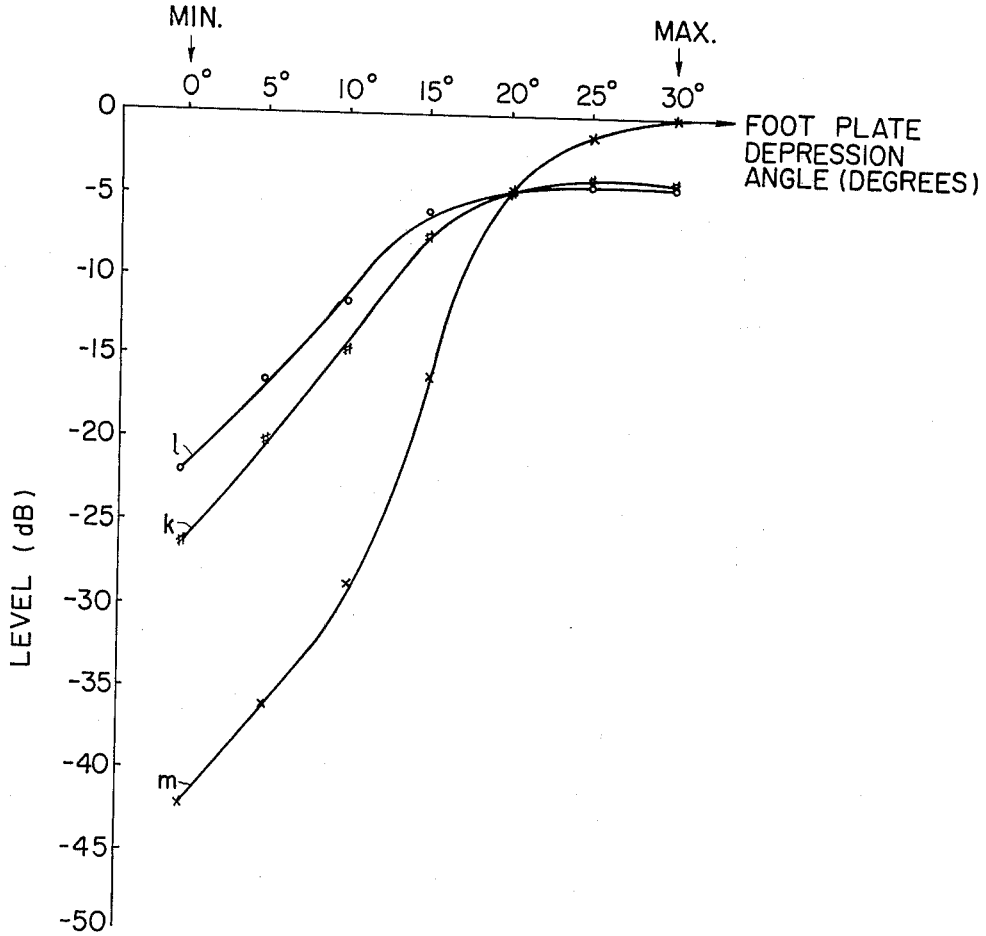
FIG. 5B is a chart of characteristic curves of the circuit of FIG. 5A.

In a concrete example, resistor R1 was 1MΩ, R2 270KΩ, R3 1MΩ, R4 1KΩ, R5 10KΩ, R6 560Ω, R7 6.8KΩ, R8 5.6KΩ, R9 10KΩ, R10 47Ω, resistances 31 and 35 1MΩ to 1KΩ, VR7 B class 100KΩ maximum, VR8 B class 500KΩ maximum, resistance 37 A class 10KΩ maximum, and C1 180 nF. The characterisitc curves in this case are shown in FIG. 5B. In FIG. 5B, curve *k* represents the characteristic when the movable contact of the variable resistor 37 is at a medium position, curve *l* the characteristic when the movable contact is at the highest position, and the curve *m* the characteristic when the movable contact is at the lowest position. As can be seen from the figure, the dynamic range is −27 to −4 dB for the curve *k*, −22 to −4.5 dB for the curve *l* and −42 to 0 dB for the curve *m*.

Figure 6:
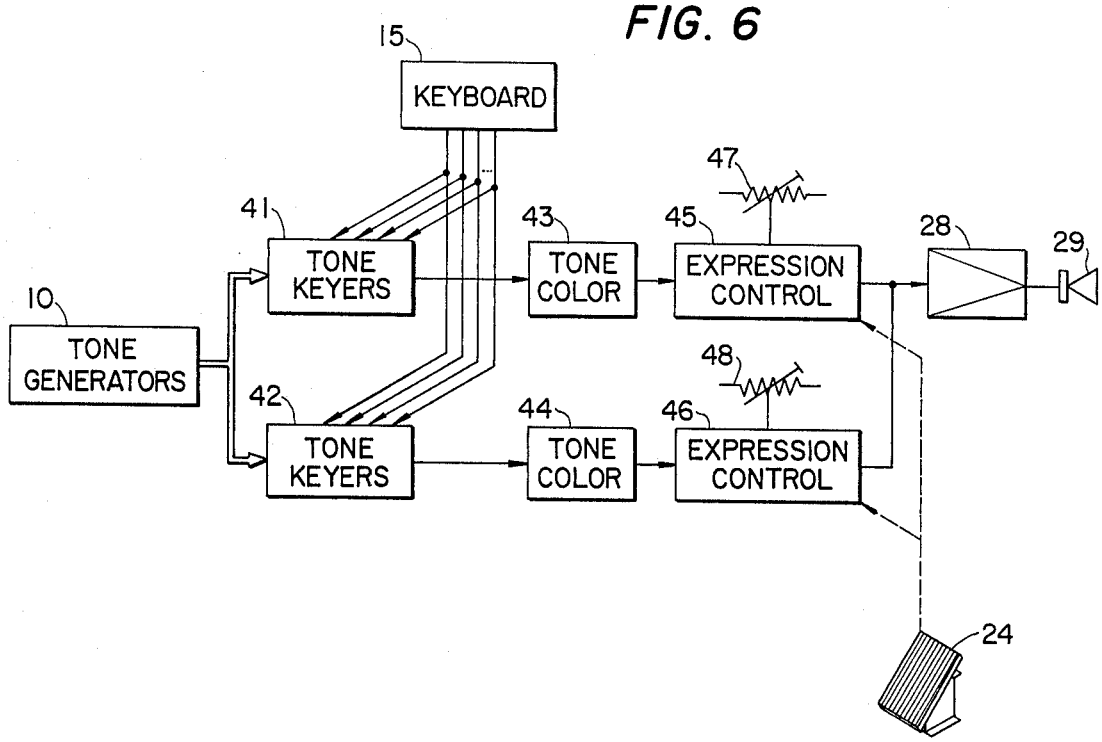
FIGS. 6 and 7 are schematic block diagrams of electronic musical instruments according to embodiments of this invention.

FIG. 6 shows an electronic musical instrument in which a plurality of tone signal generating systems is operated by a single keyboard. Namely, a keyboard 15 triggers both of tone keyers 41 and 42. The tone signals generated in the tone generators 10 and allowed to pass through the tone keyers 41 and 42 are supplied to an amplifier 28 through respective tone coloring filters 43 and 44 and expression control circuits 45 and 46 provided with manipulators 47 and 48 for varying the dynamic range. The expression control circuits may be of any structure described hereinabove or hereinbelow.

Figure 7:
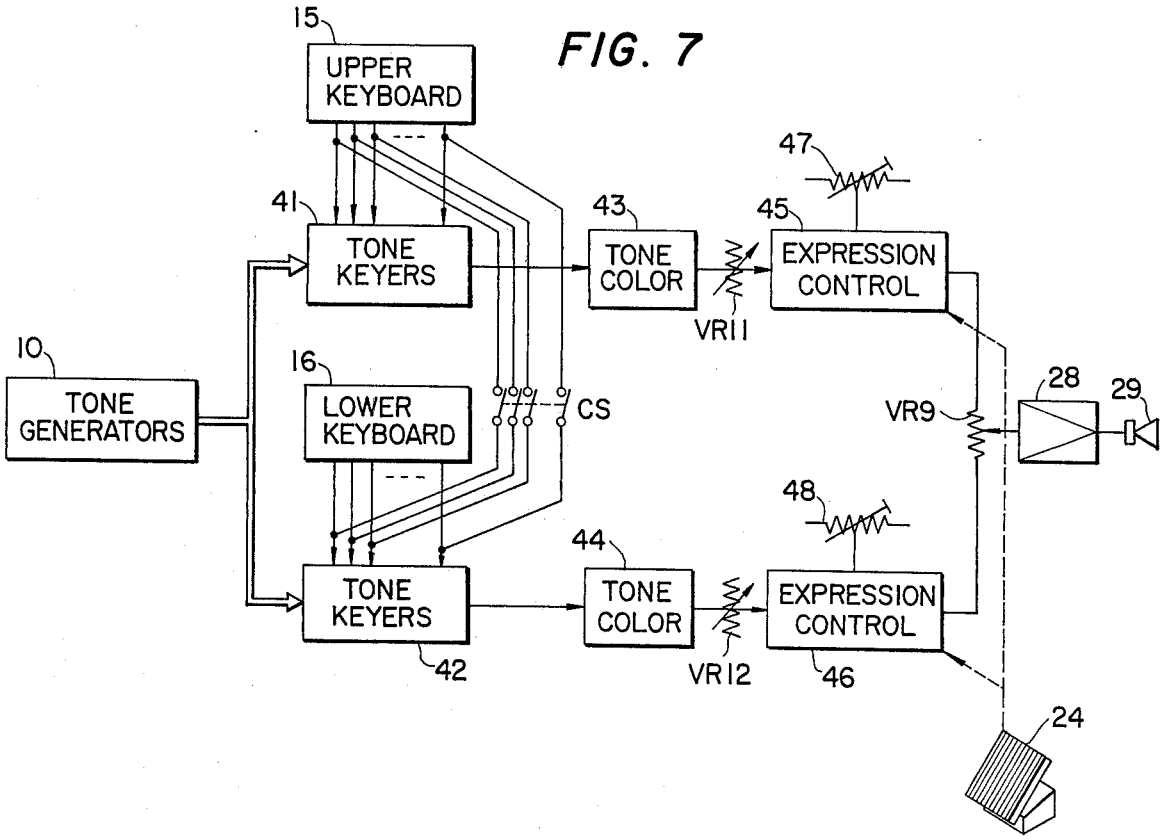

FIG. 7 shows another embodiment of an electronic musical instrument in which two tone signal generating systems are provided and actuation of the two may be coupled. Namely, an upper and a lower keyboards 15 and 16 provided to actuate tone keyers 41 and 42 may be coupled by a coupling switch Cs. Further, tone volume controlling variable resistors VR11 and VR12 are connected between the tone coloring circuits 43 and 44 and the expression control means 45 and 46, and a balancing variable resistor VR9 is provided at the input of the amplifier 28. The expression control circuits 45 and 46 are similar to those of FIG. 6 and are interlocked with an expression foot plate. Manipulators 47 and 48 may vary the dynamic range of the respective tone signals similar to those of FIG. 6. Means for varying the dynamic range may not be provided to all of the tone signal generating systems.

In the foregoing embodiments, the dynamic range is arranged to be continuously variable by means of variable resistors, but precise control of a manipulator through continuous adjustment requires care. Thus, in the course of performance rapid and precise control of a manipulator is difficult through continuous manner. Especially when there are multiple tone signal generating systems, rapid and precise control of the respective dynamic range through continuous manner is very difficult. The embodiment of FIG. 8 is to eliminate this drawback.

Figure 8:
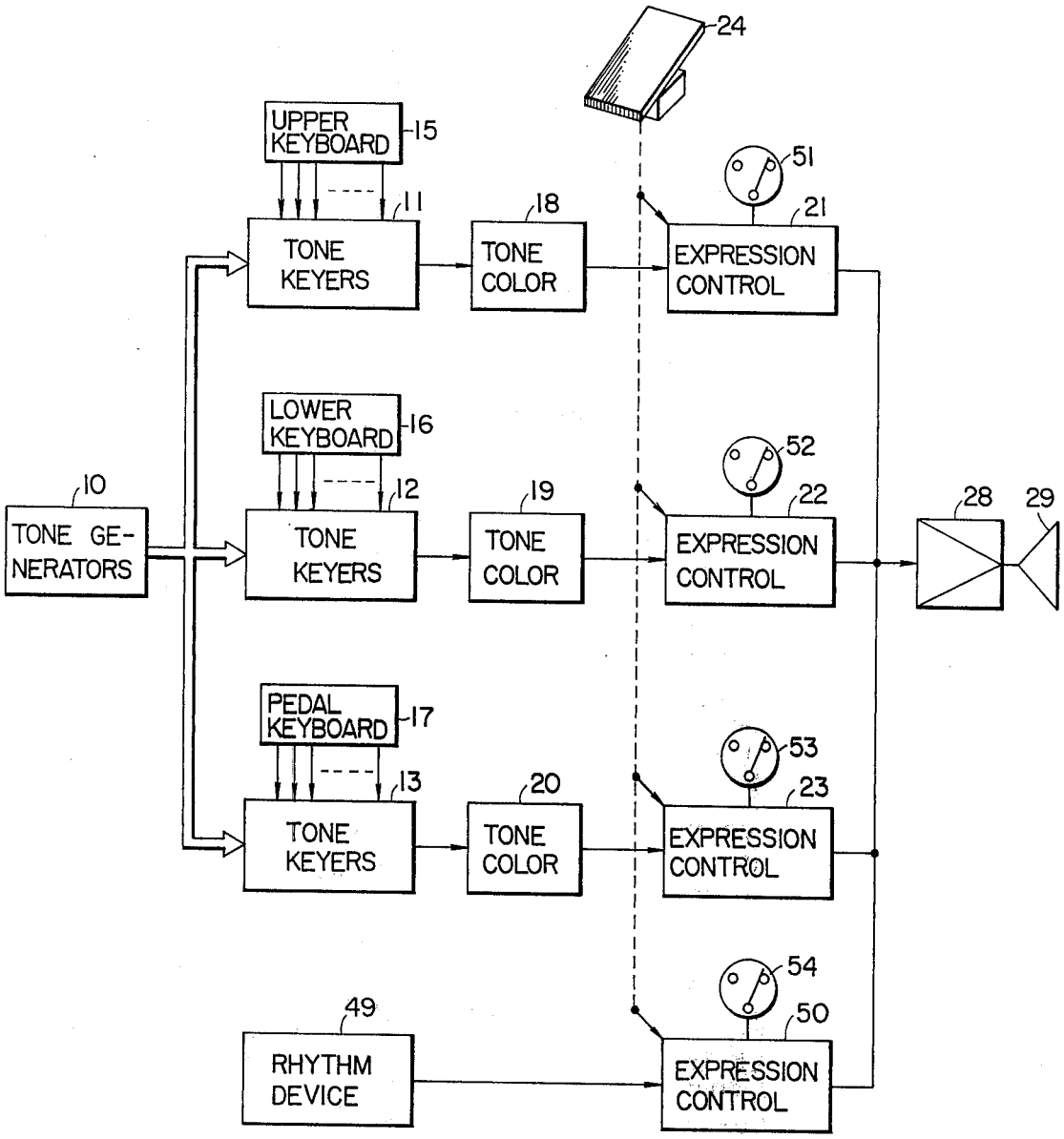
FIG. 8 is a block diagram of an electronic musical instrument according to an embodiment of this invention.

FIG. 8 shows an electronic musical instrument comprising tone generators 10, tone keyers 11, 12 and 13, upper, lower and pedal keyboards 15, 16 and 17, tone coloring circuits 18, 19 and 20, a rhythm device 49, expression control means 21, 22, 23 and 50, switching means 51, 52, 53 and 54, an expression foot plate 24, an amplifier 28, and a loudspeaker system 29. The expression foot plate 24 is interlocked with the expression control means 21, 22, 23 and 50 the dynamic ranges of which are controllable by on-off or multi-position switches 51 to 54 disposed on a manipulation panel (not shown) or at any convenient positions.

Figure 9:
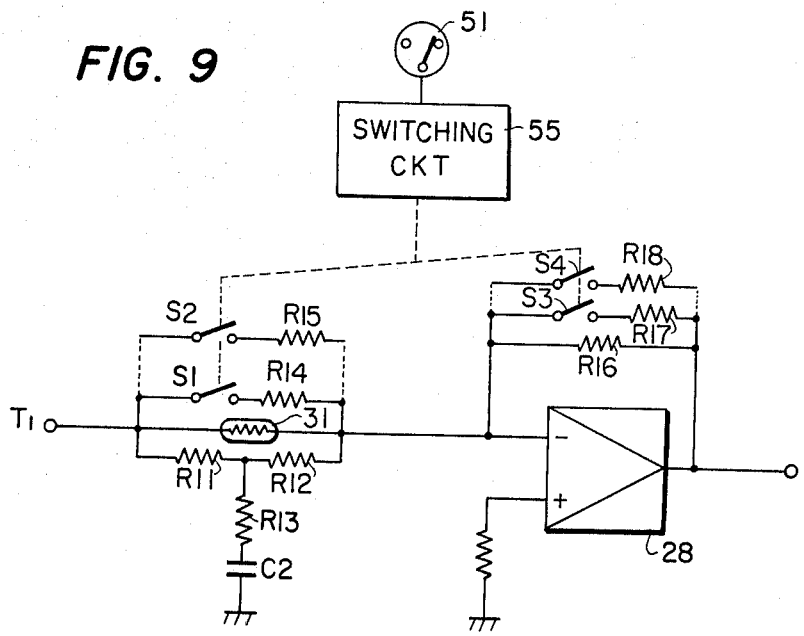
FIGS. 9 and 10 are schematic electric circuit diagrams of expression control means to be used in the electronic musical instrument of FIG. 8 according to this invention.
Figure 10:
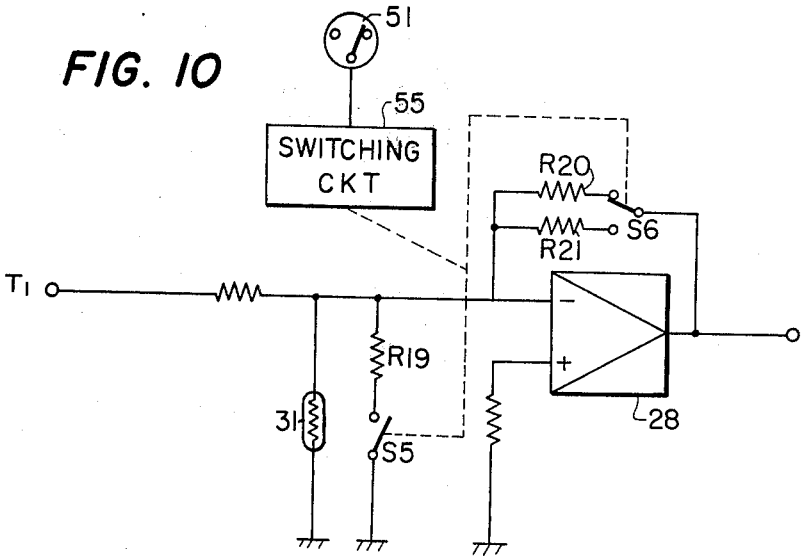

The expression circuit 21, 22, 23 and 50 may have a similar structure as shown in FIGS. 9 and 10. In FIG. 9, a photoconducting element 31 forming a part of an expression control circuit is connected between a tone coloring circuit 18 and the amplifier 28. Shunt resistors R14 and R15 are connected in parallel with the photoconducting element 31 through switches S1 and S2. The number of these shunt resistor circuits can be selected arbitrarily. A compensation network comprising resistors R11, R12 and R13 and a capacitor C2 is also connected across the photoconducting element 31 for a loudness control. Between the input and output terminals of the amplifier 28, a resistor R 16 and series connections of resistors R17 and R18 and switches S3 and S4 are connected in parallel. The switches S1–S3 and S2–S4 are interlocked and actuated by a switching circuit 55 which is activated by the manipulation switch 51. The switching circuit 55 may comprise a flip-flop circuit or a relay circuit. When the expression foot plate 24 (FIG. 8) is depressed, a shutter plate having a predetermined through hole is displaced and the amount of light impinging on the photoconducting element 31 is varied to vary the signal level supplied to the input of the amplifier 28. If the switches S1 and S3 are closed, the range of the input signal level for the amplifier 28 becomes high and narrow. Thus, the dynamic range is varied. The resistor R17 connected between the input and output terminals of the amplifier 28 decreases the amplification factor and hence works to compensate the effect of the resistor R14. As the result, the resistor R17 varies the average signal level supplied to the loudspeaker system 29. Since the switches S1 and S3 (and S2 and S4) are interlocked, the dynamic range can be varied by actuating the switch S1 (and S2) and the change in the average signal level accompanied with the change in the dynamic range can be compensated for by actuating the switch S3 (and S4).

FIG. 10 shows another embodiment of the expression control means, in which the photoconducting element 31 is connected between the output terminals of the tone coloring circuit through a resistor. Namely, the output voltage of the tone coloring circuit is divided by a series resistance of the resistors and the voltage established across the photoconducting element is supplied to the input terminals of the amplifier 28 through a resistive network. A series connection of a resistor R19 and a switch S5 is connected in parallel with the photoconducting element 31 to reduce the effect of the variation in the resistance 31. Resistors R20 and R21 and a switch S6 are connected between the input and the output terminals as shown in the figure. The switches S5 and S6 are interlocked and actuated by switching means 55 similar to the case of FIG. 9.

When the switch 51 is manipulated, the resistance R19 is connected in parallel with the photoconducting element 31 to vary the dynamic range of the colored tone signal and the switch S6 connects the resistor R21 between the input and the output terminals of the amplifier 28 to change the amplification factor of the amplifier 28 and thus to compensate for the change in the average signal level accompanying with the change in the dynamic range.

It will be apparent that switches 51 to 54 may be operated commonly or separately. Further, the resistors R4, R5, R9, etc. may be replaced with variable resistors so as to vary the dynamic range continuously.

Figure 11:
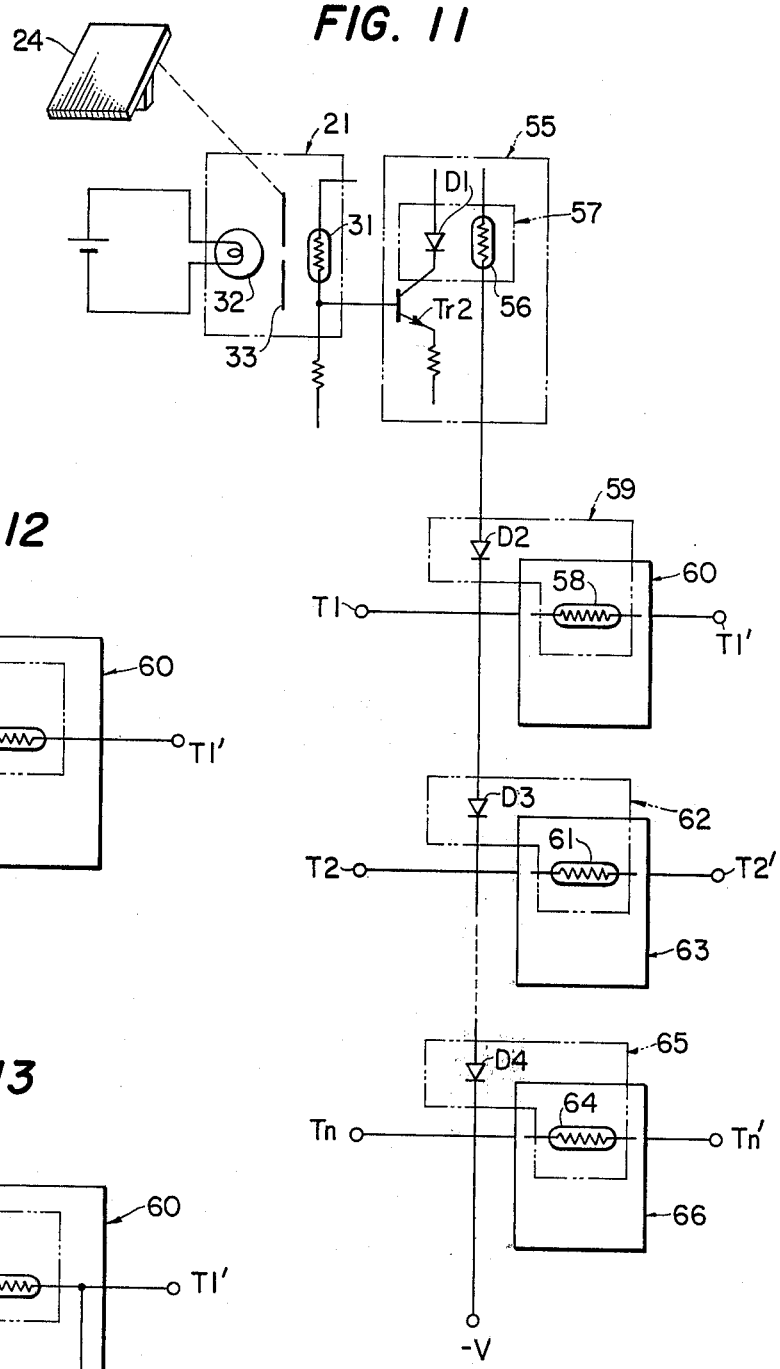
FIG. 11 is a schematic electric circuit diagrams of another embodiment of expression control means according to this invention.

When the number of tone signal generating systems is not small and mechanical interlocking system in the expression control systems brings problem, an interlocking system as shown in FIG. 11 may be adopted for the multi-channel embodiments. The circuit of FIG. 11 shows only how a plurality of expression control circuits are driven by a single foot plate. The portions for varying the dynamic range are not shown, but it will be apparent that such portions can be easily incorporated.

In FIG. 11, a block 21' including a light source 32, a photoconducting element 31 and a shutter plate 33 interlocked with an expression foot plate 24 forms a usual portion of an expression control circuit. The output of the expression control circuit portion 21' is supplied to the base of a transistor Tr2 to control the collector current thereof. The collector current flows through a light emitting diode D1 and controls the light impinging on a photoconducting element 56. Variations in the resistance of the photoconducting element 56 appear as variations of the current flowing through the photoconducting element 56 and light emitting diodes D2, D3 and D4. Namely, a block 55 forms a voltage-current converter and a block 57 forms a photo-coupler. Photo-couplers 59, 62 and 65 are formed with the light emitting diodes D2, D3 and D4, respectively. Photoconducting elements 58, 61 and 64 constitute parts of the photo-couplers 59, 62 and 65 and also components of attenuating circuits 60, 63 and 66 which reduce the signal levels supplied from terminals T1 to Tn at a desired ratio determined by the expression foot plate 24. Namely, when the expression foot plate 24 is depressed, the attenuating ratios of the attenuator circuits 60, 63 and 66 are reduced.

Figure 12:
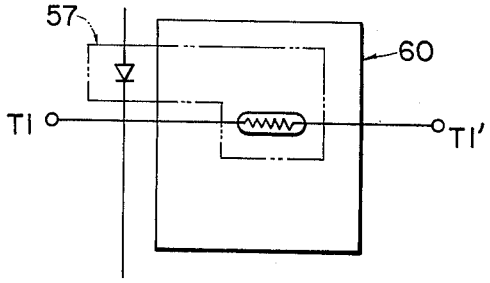
FIGS. 12 and 13 are schematic circuit diagrams of examples of the attenuator circuit to be used in the circuit of FIG. 11 according to the invention.
Figure 13:
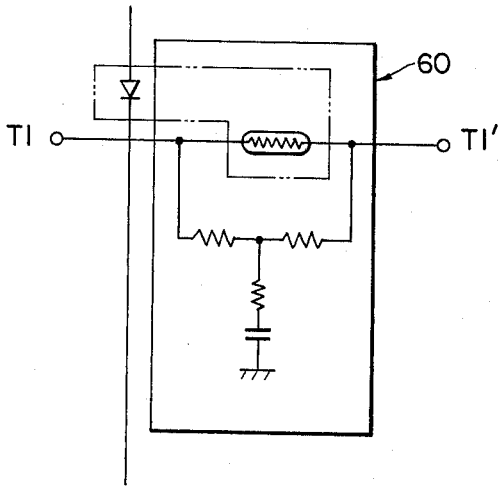

The attenuator circuits 60, 63 and 66 may have a similar structure as shown in FIGS. 12 and 13. FIG. 12 shows a simplest form of the attenuator circuit which simply comprises a photoconducting element. FIG. 13 shows another form of the attenuator circuit which comprises a photoconducting element and a loudness control circuit.

We claim:

1. An electronic musical instrument comprising means defining at least one tone signal path for passing a tone signal therethrough, said path including an output terminal and an expression control circuitry, said circuitry having a first variable impedance element for selectively varying the level of the tone signal passing through said path and a variable impedance network, said variable impedance network being connected to said first variable impedance element for adjusting, independently of the variation of said level, the variation range of the tone signal at said output terminal.

2. An instrument according to claim 1, wherein the number of said signal paths is at least two, each signal path including expression control circuitry having a first variable impedance element for varying the level of the tone signal passing through said path, and wherein said first variable impedance elements in the respective paths are interlocked.

3. An instrument according to claim 2, wherein each of said first variable impedance elements consists of a photo-coupler including a light emitting element and a photoconducting element, said light emitting elements being connected in series to be energized by a same current which is variable.

4. An instrument as in claim 1 wherein said instrument includes an amplifier having first and second input terminals and wherein said network includes a first variable resistor serially connected between said element and one of said amplifier input terminals and a second variable resistor connected between said input terminals of said amplifier.

5. An instrument as in claim 4 wherein said instrument further includes control means connected to said first and second resistors for varying the resistance thereof.

6. An instrument as in claim 4 wherein said element is a photoresistive element.

7. An instrument as in claim 1 wherein said instrument includes an amplifier having first and second input terminals and wherein said network includes a first variable resistor connected in parallel with said element and a second variable resistor connected between said input terminals of said amplifier.

8. An instrument as in claim 1 wherein said instrument includes an amplifier having first and second input terminals and an output terminal and wherein said network includes a first variable resistor connected between one of said amplifier input terminals and said amplifier output terminal and a second variable resistor connected between said input terminals of said amplifier.

9. In an electronic musical instrument of the type having means for generating at least one tone signal, means for amplifying said tone signal, expression control means connected between said generating means and said amplifying means for controlling the tone volume, and manually operated means for varying said volume, the improvement wherein said control means includes first and second variable resistor means connected to said varying means for resistance variation independently of said varying means, first circuit means for connecting said first resistor means so that variation thereof varies the range of the signal applied to said amplifying means and second circuit means for connecting said second resistor means so that variation thereof varies an extreme level of said range.

10. In an instrument as in claim 9 wherein said amplifying means includes first and second terminals and said control means further includes photoresponsive means, a light source and a manually operable shutter plate between said source and the photosensitive means.

11. In an instrument as in claim 10 wherein said first circuit means connects said first resistor means serially between said photoresponsive means and one of said terminals and said second circuit means connects said second resistor means between said first and second terminals to vary the minimum level of said range.

12. In an instrument as in claim 10 wherein said first circuit means connects said first resistor means in parallel with said photoresistive means and said second circuit means is connected between said first and second terminals to vary the maximum level of said range.

13. In an instrument as in claim 9 further including means for varying simultaneously the resistance of said first and second resistor means.

* * * * *